US008618988B2

(12) United States Patent
Fabrega-Sanchez et al.

(10) Patent No.: US 8,618,988 B2
(45) Date of Patent: Dec. 31, 2013

(54) CO-LOCATION INSENSITIVE MULTI-BAND ANTENNA

(75) Inventors: Jorge Fabrega-Sanchez, San Diego, CA (US); Joe Le, Poway, CA (US)

(73) Assignee: KYOCERA Corporation, Kyoto (JP)

( * ) Notice: Subject to any disclaimer, the term of this patent is extended or adjusted under 35 U.S.C. 154(b) by 1106 days.

(21) Appl. No.: 11/868,257

(22) Filed: Oct. 5, 2007

(65) Prior Publication Data

US 2009/0091508 A1 Apr. 9, 2009

(51) Int. Cl.
*H01Q 1/24* (2006.01)
*H01Q 1/36* (2006.01)

(52) U.S. Cl.
USPC ..... 343/702; 343/895

(58) Field of Classification Search
USPC ..... 343/702, 700 MS, 872, 873, 895
See application file for complete search history.

(56) References Cited

U.S. PATENT DOCUMENTS

| | | | | |
|---|---|---|---|---|
| 5,986,609 | A | 11/1999 | Spall | |
| 6,882,317 | B2 * | 4/2005 | Koskiniemi et al. | 343/700 MS |
| 6,995,717 | B2 * | 2/2006 | Ryu | 343/702 |
| 7,091,908 | B2 | 8/2006 | Fabrega-Sanchez | |
| 7,468,709 | B2 * | 12/2008 | Niemi et al. | 343/873 |
| 7,629,932 | B2 * | 12/2009 | Wang et al. | 343/702 |
| 2005/0099344 | A1 | 5/2005 | Okubo et al. | |
| 2005/0134510 | A1 * | 6/2005 | Asai | 343/702 |
| 2005/0270243 | A1 * | 12/2005 | Caimi et al. | 343/702 |
| 2007/0152887 | A1 * | 7/2007 | Castany et al. | 343/702 |
| 2009/0262028 | A1 * | 10/2009 | Mumbru et al. | 343/702 |
| 2010/0214180 | A1 * | 8/2010 | Krogerus | 343/702 |

FOREIGN PATENT DOCUMENTS

| | | | |
|---|---|---|---|
| CN | 1614813 | A | 5/2005 |
| CN | 1672290 | A | 9/2005 |
| EP | 1 530 256 | | 5/2005 |
| JP | 2001-217643 | | 8/2001 |
| JP | 2003-516650 | | 5/2003 |
| JP | 2005-094501 | | 4/2005 |
| JP | 2005-519509 | | 6/2005 |
| JP | 2005143044 | A | 6/2005 |
| WO | WO 01/17063 | | 3/2001 |
| WO | WO 02-13312 | | 2/2002 |
| WO | WO 03/075395 | | 9/2003 |
| WO | WO 2004010528 | A2 | 1/2004 |
| WO | WO 2005-004282 | | 1/2005 |
| WO | WO 2007 045665 | | 4/2007 |

* cited by examiner

*Primary Examiner* — Robert Karacsony

(57) ABSTRACT

The present example provides a co-location insensitive multi-band antenna. The antenna may be co-located with an antenna operated at another band and tends to reject interference from that antenna. The co-location insensitive multi-band antenna tends to provide a compact design that may be printed on a printed wiring board, on a case of a radio, such as a cellular telephone or may be self supporting. In general, the desired in band performance and out of band signal rejection may be achieved by a meander line coupled to a upper band patch. The meander line tends to provide a good lower band match, and the upper band patch tends to provide a good high band match, or resonance. The upper band patch also tends to cause a sharp roll off in return loss before the high band, that tends to reject frequencies from a co-located antenna transmitting below the high band.

17 Claims, 7 Drawing Sheets

CO-LOCATION INSENSITIVE MULTI-BAND ANTENNA

FIELD OF INVENTION

This description relates generally to antennas and more specifically to monopole antennas.

BACKGROUND

Antennas may be provided to effectively radiate radio waves, and also to; receive radio waves. Antennas can be anything from a simple wire, to a complex array of antennas coupled together such as in a radar antenna. However, all antennas share a common goal of either transforming an electrical signal to a radio wave, or transforming a radio wave into an electrical signal for further processing. Whether receiving a radio wave or transmitting one, an antenna will typically be designed to either take in the most signal possible, or transmit the most signal possible.

Antennas may be considered to be one port devices since this is typically one physical connection to an adjoining circuit. A typical aim in antenna design is to match the impedance at the port of the antenna to that of a transmitter, or other desired radio circuit (for example, an antenna switch, duplexer, low pass filter or the like). In a matched condition, a maximum amount of signal or signal power from the transmitter may be coupled to the antenna, and then radiated into the air. When receiving, a good match allows the maximum amount of power in a received radio signal to be coupled to the subsequent receiver circuits, such as a low noise amplifier ("LNA") or the like. Thus, a good match may be useful for receiving or transmitting a radio signal efficiently.

A match is typically far from perfect across a band of frequencies. Antennas are reactive devices. Thus, they have associated them with capacitance, and/or inductance. Capacitance and inductance are inherent energy storage parameters whose impedance is frequency dependent. That is when the frequency changes the impedance at the antenna port will change and the match at the antenna port will also change. A designer may find that an antenna optimized to provide the best possible match at one frequency, will provide an unsatisfactory match at another frequency in the band of operation. A designer will often seek to design an antenna that has an acceptable match across the band of operation, or even several bands of operation that may not necessarily be the best one that could be obtained at a single frequency.

This is one reason why there are so many types of antennas. Aside from antennas designed to optimize other parameters, such as antenna gain, beam shaping, and the like, different designs may be needed to achieve a good match at the operating frequency. Achieving an acceptable match over a given range of frequencies can be difficult and may require differing configurations to achieve the desired results.

Other parameters that can affect an antenna's design and final form, may include the environment the antenna is used in and the space available for the antenna. The presence of objects near the antenna, such as a cell phone user's head, large metal surfaces and other antennas can also affect the design. Physical space constraints can lead to configurations such as antennas that pull out from the body of a cell phone and antennas that appear to be a knob or stub on the telephone case and other unique designs.

In particular, the presence of other antennas can affect an antenna's performance. For example, an antenna receives energy just as easily as it transmits it. If two antennas are located next to each other and one is transmitting while the other is receiving, the energy from the transmitting antenna can impinge on and interfere with the adjacent antenna's associated receiver. It does not matter that each of the antenna's are optimized for different frequency ranges. If the antennas are close, even a weak coupling (due to different bands of operation) between the antennas will still transmit a substantial amount of energy into the receiver from the adjacent antenna transmitter. Energy from an antenna falls off at roughly the inverse of the square of the distance from the antenna. Thus, when the antennas are close, the density of energy impinging on an adjacent antenna and receiver can be quite strong.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some of the concepts disclosed herein, in a simplified form as a prelude to the more detailed description that is presented later.

The present example provides a co-location, insensitive multi-band antenna. The antenna may be co-located with an antenna operating at another band and tends to reject interference from that antenna. The co-location insensitive multi-band antenna, tends to provide a compact design that may be printed on a printed wiring board ("PWB") or on a case of a radio, such as a cellular telephone.

In general, the desired in band performance and out of band signal rejection may be achieved by a meander line coupled to an upper band patch. The meander line tends to provide a good lower bad match, and the upper band patch tends to provide a good high bad match, or resonance. The upper band patch also tends to cause a sharp roll off in return loss before the high band, that tends to reject frequencies from a co-located antenna transmitting below the high band.

Many of the attendant features will be more readily appreciated, as the same becomes better understood by reference to the following detailed description considered in connection with the accompanying drawings.

BRIEF DESCRIPTION OF THE DRAWINGS

The present description will be better understood from the following detailed description read in light of the accompanying drawings wherein.

Like reference numerals are used to designate like parts in the accompanying drawings.

DETAILED DESCRIPTION

The detailed description provided below in connection with the appended drawings, is intended as a description of the present examples and is not intended to represent the only forms in which the present example of a co-location insensitive multi-band antenna may be constructed or utilized. The dimensions of the meander line and upper band patch are configuration sensitive, as the co-location insensitive multi-band antenna is a distributed circuit. However, those skilled in the art will realize that variations in the configuration may be introduced to achieve the same design goals. The description sets forth the functions of the example and the sequence of steps for constructing and operating the example. However, the same or equivalent functions and sequences may be accomplished by different examples.

The examples below describe a co-location insensitive multi-band antenna. Although the present examples are described and illustrated herein as being implemented in a printed wiring system for operation in a cellular telephone at certain frequency bands, the system described is provided as an example of a co-location insensitive multi-band antenna and not a limitation. As those skilled in the art will appreciate, the present examples are suitable for application in a variety of different types of radio systems for transmitting radio signals at other frequencies without being susceptible to co-location interference from other similarly configured interfering frequency bands.

Figure 1:
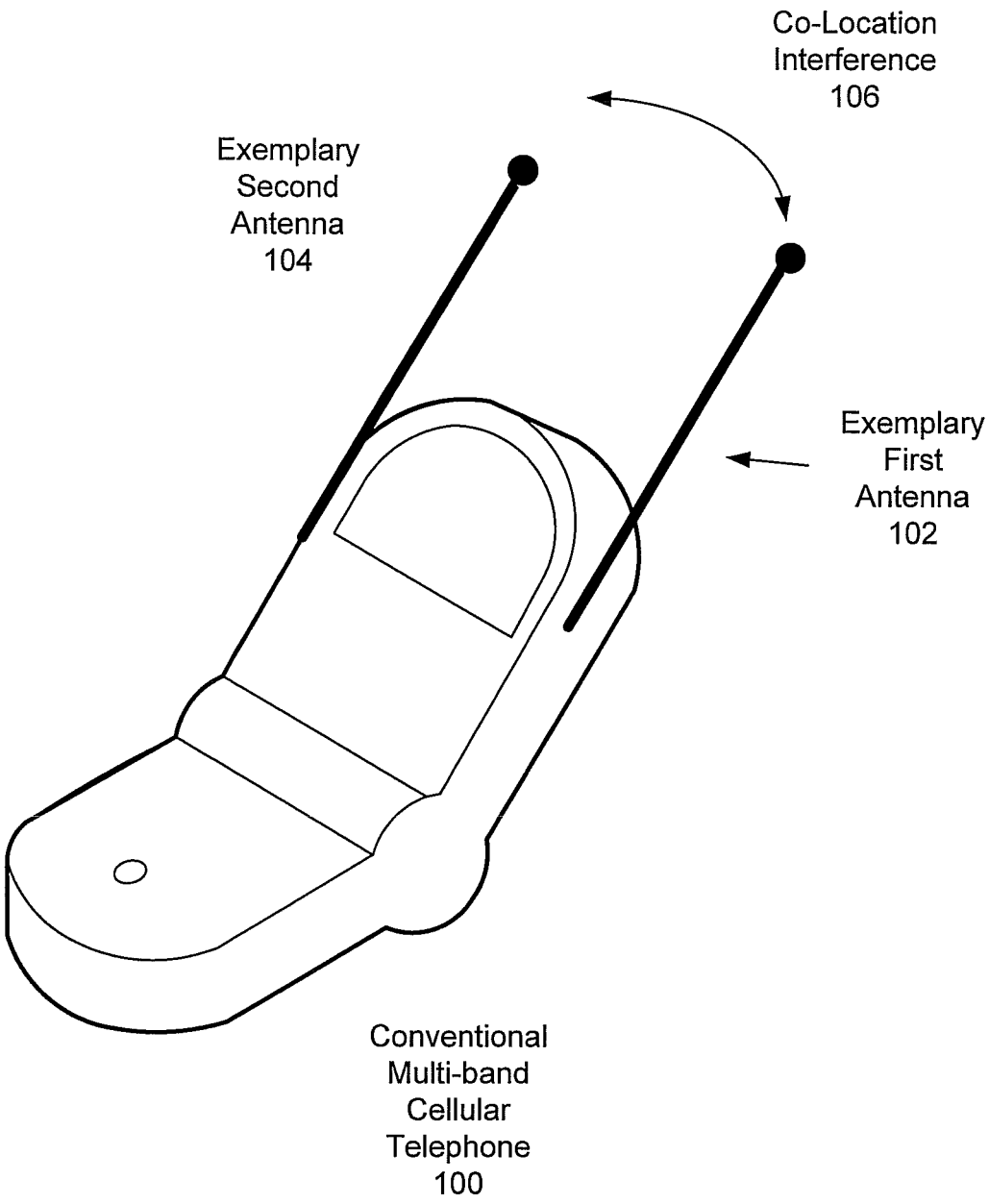
FIG. 1 shows a conventional multi-band cellular telephone equipped with antennas that tend to present co-location interference problems.

FIG. 1 shows a conventional multi-band cellular telephone equipped with antennas that tend to present co-location interference problems. As shown, a conventional multi-band cellular phone 100, can be equipped with one or more antennas 102 and 104. This configuration would typically arise when two bands of operation may be provided for in the cellular phone 100.

For example, the frequency of operation of the first antenna 104 may be incompatible with the frequency band of operation of the second antenna 102. Thus, two antennas would be provided so that the signals from each band may be satisfactorily transmitted from the multi-band cellular telephone 100.

However, in this arrangement, co-location interference 106 can be a problem. When one antenna is transmitting, the other antenna will be acting as a receiver picking up energy from that other antenna. Since the antennas are so close together, even a weak coupling will result in substantial power from one antenna entering the other antenna and causing potential problems such as overload of a receiver and the like. Antennas may include circuitry, such as antenna matching networks and the like, that tend to act to reject co-location interference 106. However, circuitry such as antenna matching networks may require tuning and may add additional loss to the radio circuitry. Typically, it would be more desirable to have an antenna that tends to be insensitive to co-location interference that may be compactly disposed within the casing of a cellular telephone or the like.

Figure 2:
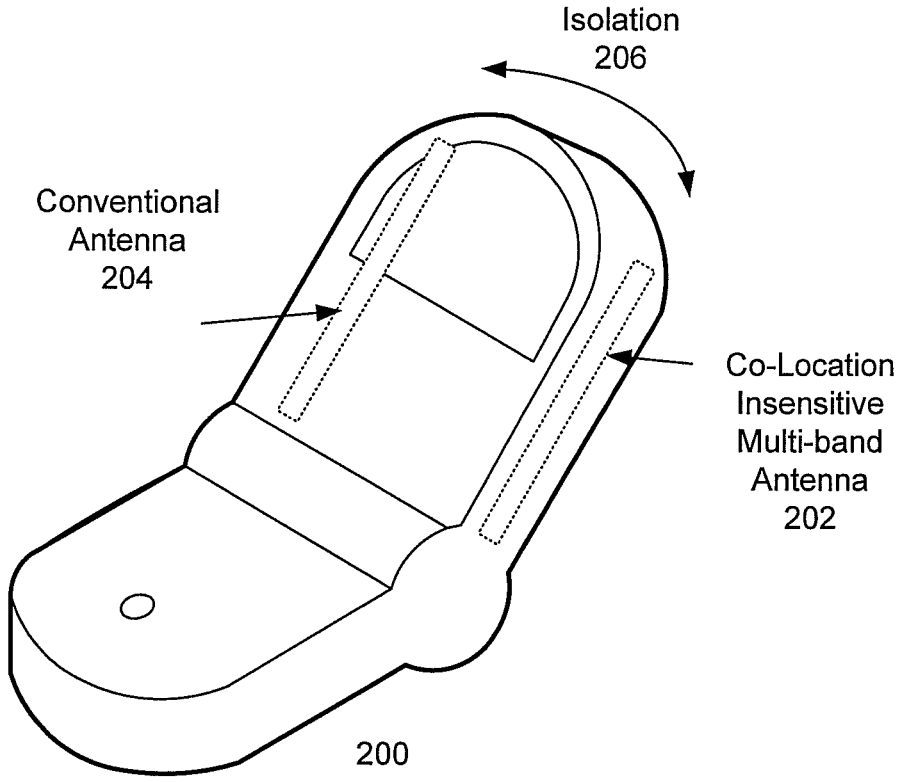
FIG. 2 shows a multi-band cellular telephone equipped with a co-location insensitive multi-band antenna that tend to present good isolation against co-location interference.
Figure 2:
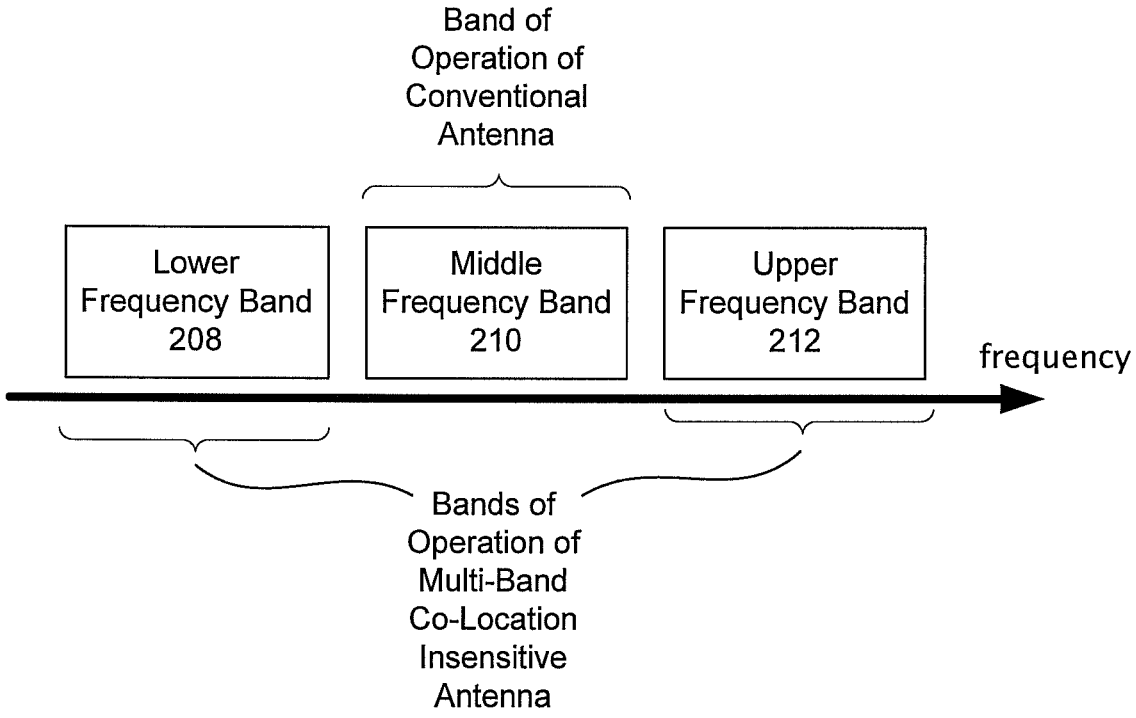

FIG. 2 shows a multi-band cellular telephone equipped with a co-location insensitive multi-band antenna, that tends to provide good isolation against co-location interference 202. A conventional antenna 204, for a middle frequency band of operation 210, may be included in a multi-band cellular telephone 200. A second multi-band co-location insensitive multi-band antenna 202 may also be included in the telephone 200. The co-location insensitive multi-band antenna 202 transmits the lower frequency band 208 and the upper frequency band 212.

First exemplary antenna 204 may be an external antenna built as any conventional antenna structure. The frequency band of operation for the first antenna may be in the exemplary GPS frequency band. The first antenna 204 typically transmits on a band that lies in between the bands of transmission of the second co-location insensitive multi-band antenna 202. In alternative examples, the first antenna 204 may be transmitting in another middle frequency band with the co-location insensitive multi-band antenna 202, that is properly frequency scaled in design to reject the band of operation of the first antenna 204.

The exemplary co-location and sensitive multi-band antenna 202 may be a multi-band antenna and may be configured to receive lower band (or bands) of frequencies 208 and an upper band of frequencies (or bands) 212. In the examples described below, the co-location insensitive multi-band antennas may be configured to work with transmitting and receiving in the AWS band as an upper band 212. The AWS band has a typical transmission frequency range from 1,710-1,755 MHz. The AWS band has a typical receive band from 2,110-2,155 MHz. Between the receive and transmit frequencies of the AWS bands, a PCS band may also be present. A typical PCS frequency range is from 1,850-1,990 MHz. The lower band 208 may be the AMPs band or its equivalent. The AMPs (or US Cellular) frequency range typically ranges from 824-894 MHz.

In alternative examples, the co-location insensitive multi-band antenna may be designed to transmit and receive on other frequency bands as well as reject interference from a first antenna 204, operating at a different frequency band. The design approach to producing the co-location insensitive multi-band antenna may be applied to other frequencies as long as the relationship shown 208, 210, 212 is present. For example, the frequency bands 208, 210, 212 may have a relative distance in frequency from each other that may be maintained, but the bands may be shifted up or down the frequency spectrum as a group. Typically, frequency scaling or other equivalent methods may be used to adjust the design frequency of operation of the co-location insensitive multi-band antenna 202 to operate at other bands similarly configured and proportioned with respect to each other.

In addition, any number of frequencies or frequency bands may be present in the upper band 212. And any number of frequency bands or frequencies may be present in the lower frequency band 208. Likewise, any number of frequencies, or frequency bands may be present in the middle band 210. However, as long as the relationships between the bands remain as shown, the co-location insensitive multi-band antenna design concept may be used.

The co-location insensitive multi-band antennas 202, 204 tend to provide isolation 206 between the co-located antennas in the cellular telephone 200. The construction of the co-location insensitive multi-band antenna 202 is such that radiation from the first antenna 204 tends to be rejected and prevented from entering circuitry coupled to the second co-location insensitive multi-band antenna 202.

The co-location insensitive multi-band antenna 202 may be disposed on a circuit board that is part of a main multi-band cellular telephone circuit board, or a sub-assembly of that board, that can be part of the cellular telephone 200. Alternatively, an independent and separate circuit board, including the co-location insensitive multi-band antenna 202, may be disposed on the housing of the cellular telephone and coupled to cellular telephone circuitry by conventional methods.

Figure 3:
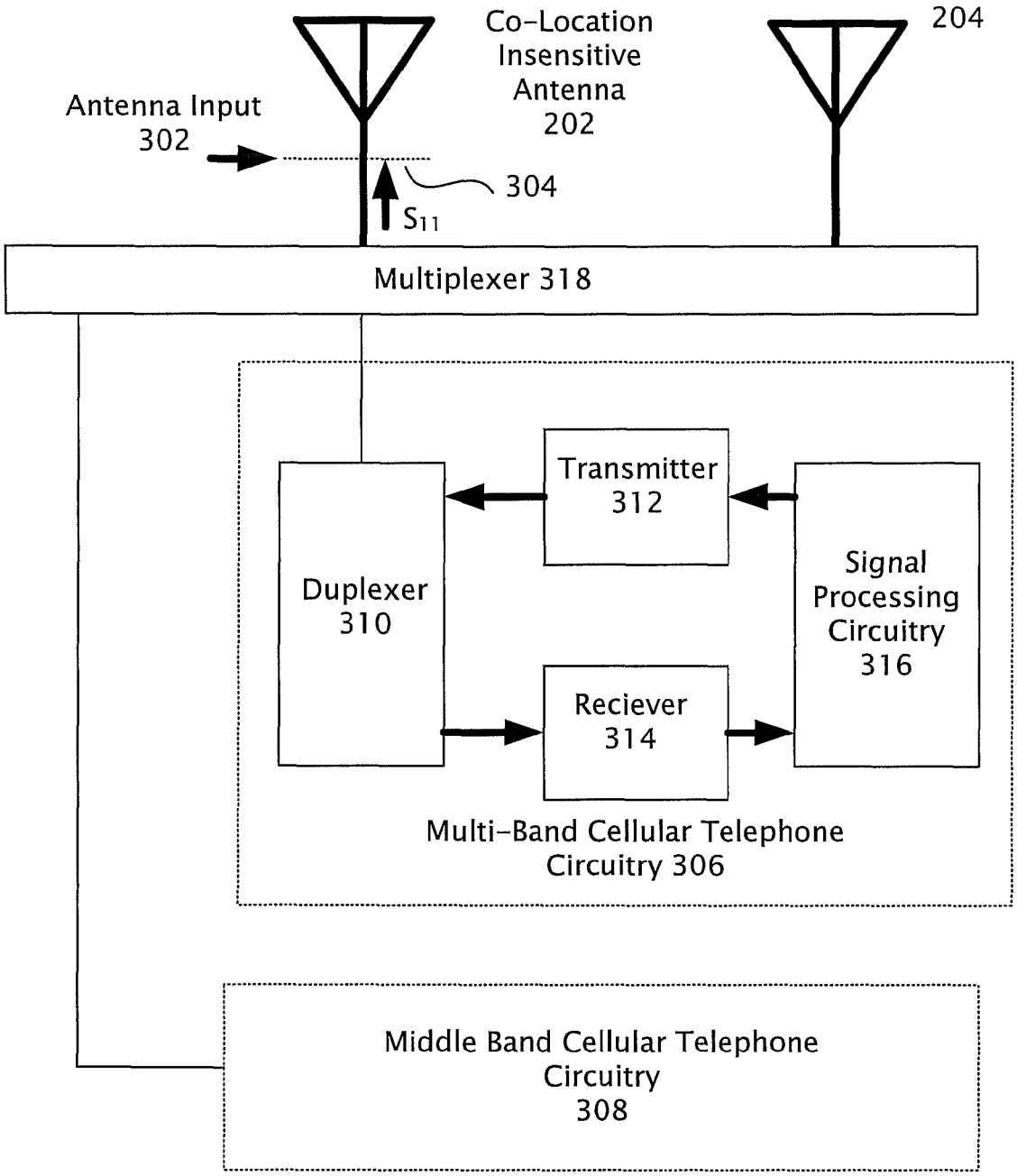
FIG. 3 shows a block diagram of a portion of a cellular telephone equipped with a co-location insensitive multi-band antenna.

FIG. 3 shows a block diagram of a multi-band cellular telephone equipped with a co-location insensitive multi-band antenna. The co-location insensitive multi-band antenna 202 is typically coupled to a conventional multiplexer 318, which in turn can be coupled to a conventionally constructed multi-band (or prior band) cellular telephone circuitry 306. The conventionally constructed multi-band cellular telephone circuitry 306 is simply an example for illustration purposes. Any suitable multi-band transceiver arrangement may be used with the co-location insensitive multi-band antenna.

At the antenna input port 302, a figure of merit $S_{11}$ 304 or its equivalent may be measured. Scattering parameter $S_{11}$ can be measured by injecting a test signal into the antenna input port 302 of the co-location insensitive multi-band antenna 202 and by measuring the ratio of the reflected signal to that if the incident signals.

Scattering parameter $S_{11}$ is a figure of merit that gives an indication of the match between the co-location insensitive multi-band antenna 202 and the multi-band cellular telephone circuitry 306, as seen through the multiplexer 318. Scattering parameters are vector quantities and as such may be expressed by complex numbers, or by magnitude and angle form. The absolute value of the magnitude of $S_{11}$ is defined as the return loss and is also a valuable figure of merit when evaluating the match between the co-location insensitive multi-band antenna 202 and the primary multi-band telephone circuitry 306, as seen through the multiplexer combination. Return loss is simply a scalar quantity and expressed as a positive number. The return loss ($|S_{11}|$) varies with frequency and by examining this figure of merit, a design engineer is able to determine how well the multi-band cellular circuitry 306 is matched and thus, delivers a signal to the antenna 202. A large positive number for return loss is desirable, but in practice 5-18 dB, return loss are typically considered a good match. It also indicates how well interfering radiation from the antenna 204 is rejected by the co-location insensitive multi-band antenna 202. Typically, resonances in circuits such as the co-location insensitive multi-band antenna circuits can cause improvements to the input return loss. Controlling at which frequencies resonances will occur may be difficult to control and creating a design, such as the co-location insensitive multi-band antenna 202 that satisfactorily places those resonances where they are desired, is typically difficult to achieve.

The multi-band cellular telephone circuitry 306 is conventionally constructed to operate transmitting and receiving on multiple cellular bands. In the example shown, AWS band, the PCS band and the AMP band, may be transmitted and received through the multi-band cellular telephone circuitry 306 (via the multiplexer 318) and the co-location insensitive multi-band antenna 202, as the antenna 202 provides a good match to the multi-band cellular telephone circuitry 306 over the frequency band of transmission and reception of the circuitry 306.

Multi-band cellular telephone circuitry 306 is conventionally constructed and may include a duplexer or diplexer 310, a receiver 314 coupled to the duplexer and also coupled to a single processing circuitry 316. Signal processing circuitry 316 is conventionally constructed and includes an output coupled to a conventionally constructed transmitter 312, which is in turn coupled to the duplexer 310. The duplexer or an equivalent circuit typically allows for duplex communications over a cellular telephone where the voice or other information may be transmitted and received simultaneously. In place of a duplexer, a diplexer, a coupler, a circulator or other equivalent circuit may be applied.

The transmitter 312 is conventionally constructed. It typically includes circuitry for amplifying a voice or data signal from the signal processing circuitry 316 before it is transmitted out the antenna 202 via duplexer 310.

The receiver 314 is conventionally constructed and typically includes circuitry to provide one or more stages of down conversion of an incoming signal such that it may be processed by a signal processing circuitry 316. Single processing circuitry 316 is conventionally constructed so that a voice signal being transmitted or a data signal being transmitted may be properly modulated before application to transmitter 312. Signal processing circuitry 316 may also include circuitry to convert a received signal into an audible signal, or a received data signal using conventional demodulation techniques. In processing multiple bands, multiple circuits may be provided, or the individual circuits may be configured to process radio signals from multiple bands.

Antenna 204 is conventionally constructed and coupled to conventionally constructed secondary (or middle band) cellular circuitry 308 through the multiplexer 318. In the example shown, the secondary cellular telephone circuitry 308 and antenna 204 may be configured to transmit and receive in the GPS band of frequencies, typically at 1,575 MHz, but measured from 1,565 to 1,585 MHz. In alternative examples, other frequencies and modulation methods may be applied to the secondary cellular telephone circuitry 308 with proper scaling and design techniques applied.

Splitting cellular telephone circuitry into two or more separate assemblies 306 and 308, allows functions that are not easily integrated onto a single electronic assembly or integrated circuit to be separated easily for ease of manufacture and design. As previously discussed, the co-location insensitive multi-band antenna 202 is constructed to reject signals and impinging from the second antenna 204, by virtue of the signal rejecting properties of the antenna 202.

Figure 4:
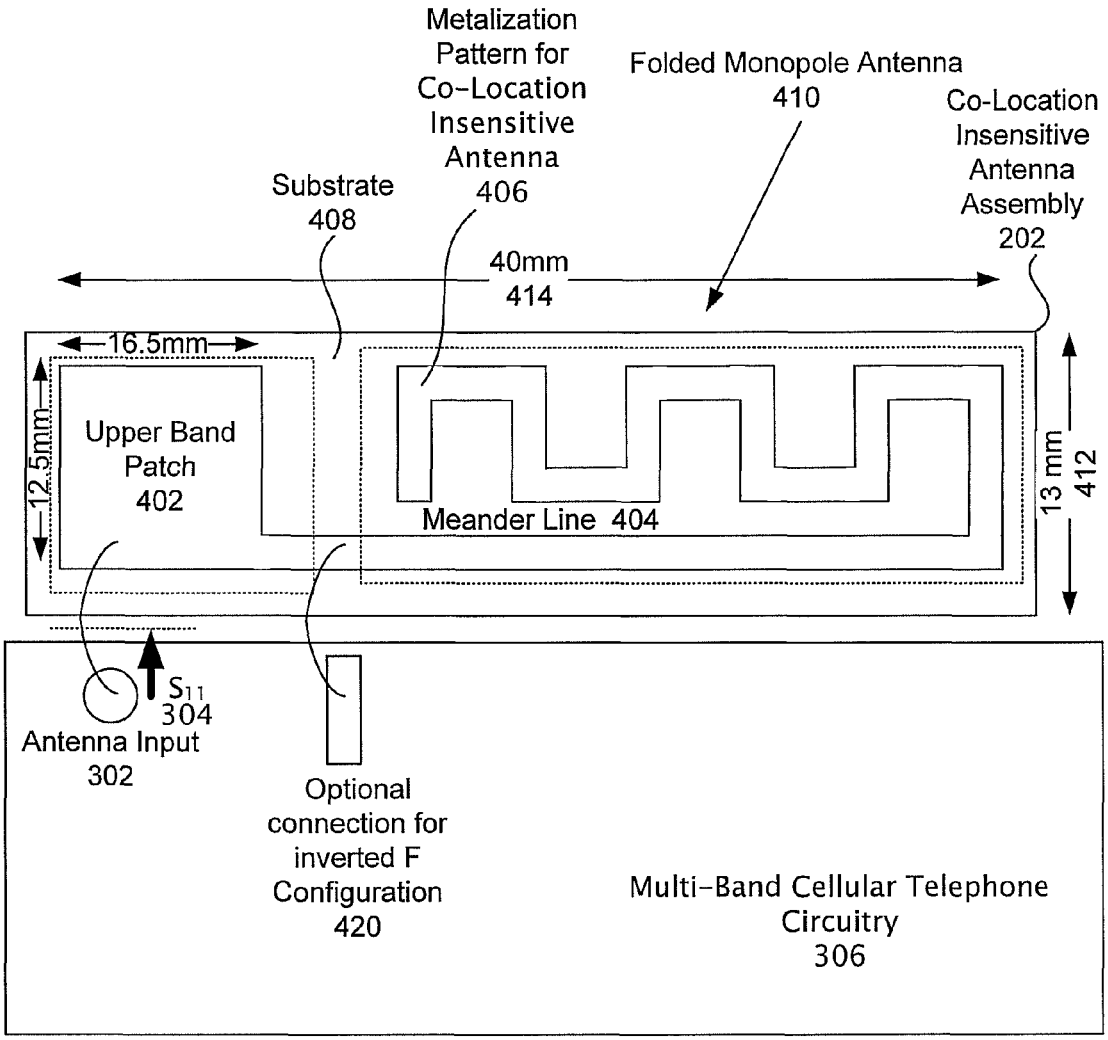
FIG. 4 shows a pictorial diagram of a co-location insensitive multi-band antenna printed wiring assembly coupled to a cellular telephone.

FIG. 4 shows a pictorial diagram of a co-location insensitive multi-band antenna printed wiring assembly 202 coupled to cellular telephone circuitry 306. The antenna input 302 couples the cellular telephone circuitry 306 to a co-location insensitive multi-band antenna assembly 202 by conventional methods. It is at this point, looking into the printed wire assembly 202 that the figure of merit $S_{11}$ 304 may be measured.

The assembly 202 includes a metallization pattern of the co-location insensitive antenna 406 disposed upon a substrate 408. The metallization pattern 406 may include a microstrip antenna element (or upper band patch) 402 and a meander line 404. In the example shown, the dimensions of the co-location insensitive multi-band antenna assembly 202, are approximately 40 millimeters by 13 millimeters. The co-location insensitive multi-band antenna assembly 202 has two main components. The two components are, the upper band patch and the meander line 404 which may act as a folded monopole antenna 410. This combination of elements allows the desired antenna performance with the desired resonances as measured by $S_{11}$ to be achieved.

In an alternative embodiment, the antenna assembly 202 may be disposed on the case of a cellular telephone or other radio assembly. For example, the cellular circuitry 306 may be coupled to a metallization pattern disposed upon the interior of a plastic or other suitable material case or housing for a cellular telephone.

Also shown is an optional connection 420, which may be used in an alternative example of configuring the folded monopole co-location insensitive antenna as an inverted-F ("IFA") antenna. The Inverted-F configuration typically creates an additional resonance. A first radiating branch of the antenna may be coupled to a signal feed conductor and a ground feed conductor. A second radiating branch may be coupled to the signal feed conductor and the ground feed conductor at one end and may be capacitively coupled to the first radiating branch at the other end so that the antenna resonates at an additional resonance frequency, which may be used to add multi-band capabilities.

Figure 5:
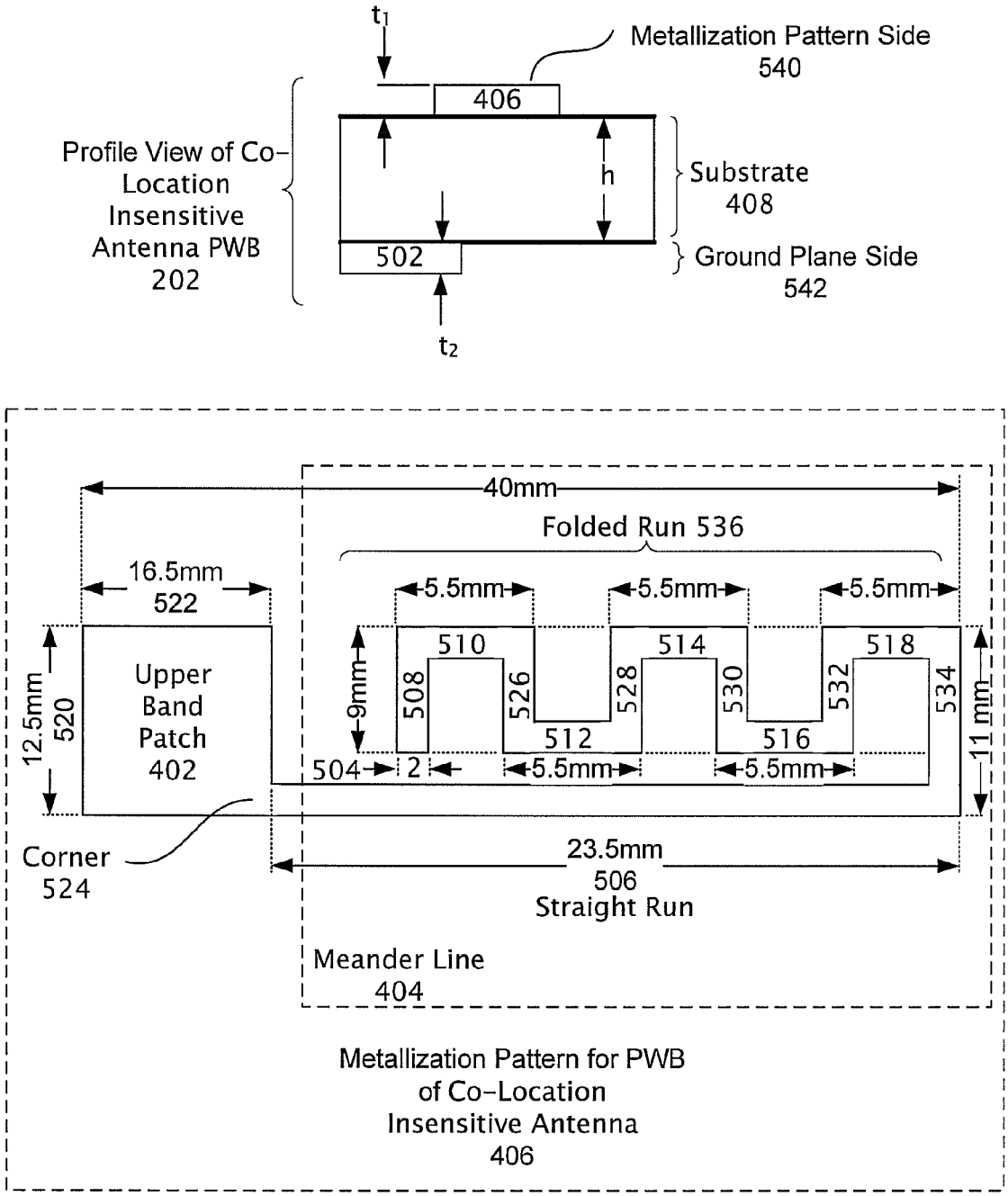
FIG. 5 is a lay out of a metallization pattern for the co-location insensitive multi-band antenna printed wiring assembly.

FIG. 5 is a layout of a metallization pattern 406 for the co-location insensitive multi-band antenna printed wiring assembly (202 of FIG. 4). This pattern is simply an example of a variety of patterns that may be constructed, as equivalent performance may be achieved with different dielectric constants, dielectric thicknesses and pattern dimensions. Also, the number of bends in the meander line are typically not controlling of the antenna performance, and the number of bends may be adjusted as desired. A profile view of the PWB for the co-location insensitive multi-band antenna assembly shows that the PWB assembly may be made up of three layers 540, 408, 542. The first layer is a metallization pattern side 540 that includes the metallization pattern of the co-location insensitive multi-band antenna 406. The metallization layer has a thickness suitable to preserve its shape or otherwise support the antenna, and may be made from copper or other equivalent material. The next layer or middle layer, may be a substrate 408 of suitable thickness or height h which may be sufficient to support the metallization layer.

Alternatively, the substrate may be omitted in alternative examples of the antenna, where the metallization is thick enough to preserve the antenna shape without the aid of a substrate. Other equivalent metallization may be produced by more rigid materials such as sheet metal, or the like, if desired.

The example shows that a third or bottom layer may be present. However, in alternative examples having a ground plane or other obstruction in the third layer that may partially cover or otherwise overlap the metallization, performance may be reduced. Thus, the presence of a ground plane may reduce the efficiency of the antenna, and thus, the bottom layer is typically kept clear of grounds and other obstructions.

Those skilled in the art will realize that the metallization pattern 406 may have given a set of dimensions for a substrate having given characteristics. However, if the substrate parameters are varied, the metallization pattern 406 may be varied to achieve similar performance parameters (such as $S_{11}$).

The metallization pattern for the PWB of the co-location insensitive multi-band antenna 406, may be divided into two regions, upper band patch region 402 and the meander line region 404. The meander line region 404 may be further subdivided into a region of a straight run 506 and a region of a folded run 536. The straight run and folded run may be coupled in series or cascaded, with the folded run following the straight run. The opposite end of the straight run can be coupled to a corner 524 of the upper band patch 402.

The exemplary upper band patch 402 may be conventionally constructed of copper or other suitable metallization and has a typical width of 16.5 millimeters 522 and a typical length of 12.5 millimeters 520. A corner 524 on the upper band patch 402 couples to the meander line 404 subsection, typically at a first end of the straight run 506.

Meander line section 404 has a first end of the straight run 506 typically coupled to the corner of the upper band patch 402. At the opposite end of the straight run, the straight run typically couples to a first end of the folded run 536. The straight run 506 may include a straight section of transmission line typically 2.0 millimeters wide and 23.5 millimeters long.

The folded run 536 may include cascaded transmission line elements 508, 510, 526, 512, 528, 514, 530, 516, 532, 518 and 534. In the example shown, the transmission line segments that make up the folded run, may be 2.0 millimeters wide. Segments 508, 526, 528, 530 and 532 may be 9.0 millimeters long. Transmission line segment 534 is typically 11 millimeters long. Transmission line segments 510, 512, 514, 516, and 518 are typically 5.5 millimeters long.

In the folded run section 536, the transmission line sections may be cascaded in the following order: 534, 518, 532, 516, 530, 514, 528, 512, 526, 510 and 508. At the junction of each cascaded segment, a 90 degree turn may be made to meander the line. At the 90 degree turn, the edges are un-chamfered. In an alternative example, the corners of the transmission line at the 90 degree junctions may be dog eared, mitered, chamfered or the like, to reduce parasitic capacitance. In further alternative examples, alternative meandering patterns may be provided.

Figure 6:
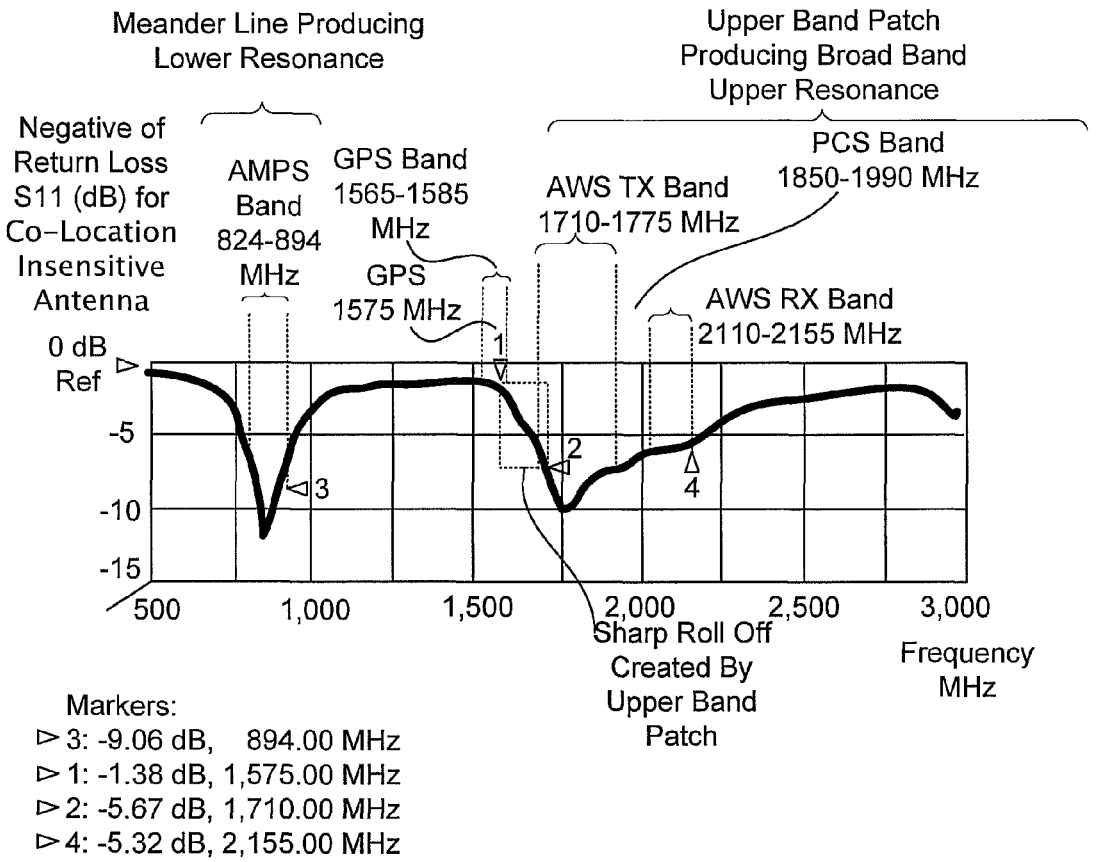
FIG. 6 is a graph relating typical return loss of the co-location insensitive multi-band antenna to various cellular telephone bands.
Figure 6:
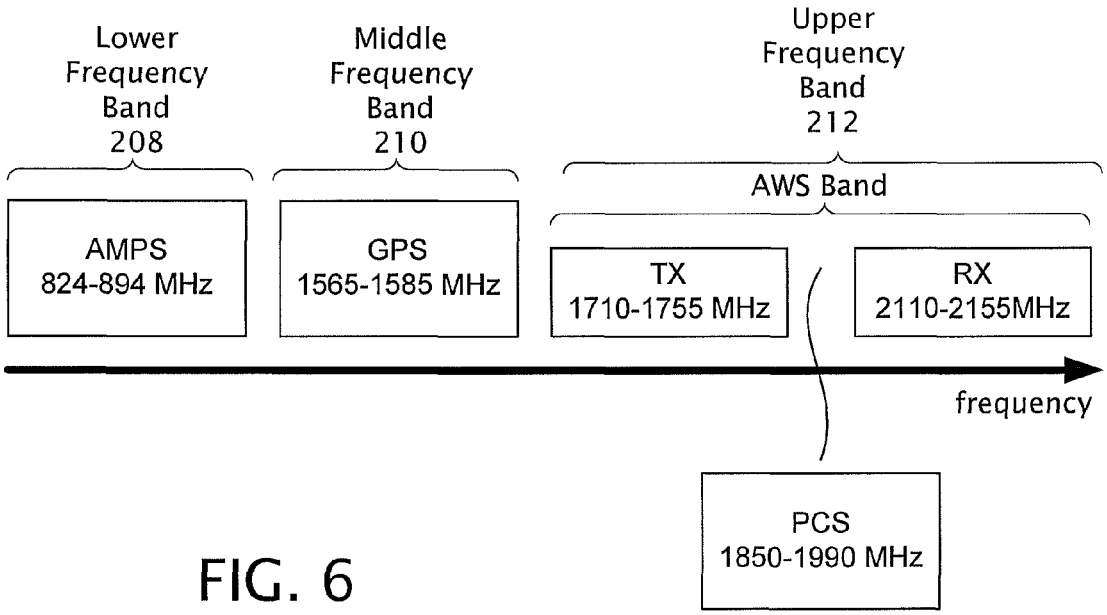

FIG. 6 is a graph relating typical return loss of the co-location insensitive multi-band antenna to various cellular telephone bands for the previously described example. As shown, the negative of return loss in decibels (dB) is graphed against frequency in megahertz (MHz). A plot such as this is a typically produced on the display of an instrument measuring the vector scattering parameters in magnitude angle form. The angle is not shown but the return loss is found from the plot by simply taking the negative of the number graphed on the vertical axis.

Scattering parameters (or "S parameters) may be used to characterize a high frequency device such as the co-location insensitive multi-band antenna. Antennas may be considered to be one port devices. As such, a one port device would be characterized by the single scattering parameter $S_{11}$. This parameter is a measure amount of power that bounces off, or is returned from, a port to that delivered to a port. The magnitude of $S_{11}$ in db, is typically termed the return loss and may be used as a figure of merit to judge how well power is delivered to a circuit. A large number for return loss indicates that most of the power goes through the port and little is returned to the originating circuit.

Return loss is typically the ratio, at a port of a device, of the amplitude of the reflected power to the amplitude of the incident power. The return loss value describes the reduction in the amplitude of the reflected energy, as compared to the forward energy. For example, if a device has 16 dB of return loss, the reflected power from that device is always 16 dB lower than the forward power presented. For all devices that include reactive elements, the return loss value typically varies with frequency.

A return loss of 0 db indicates that all of the power delivered to a port is returned back to the circuit from which it came. This typically indicates that there is an open or short circuit in the device. In the case of a transmitter, having all of the power reflected back into the transmitter typically damages the transmitter. A relatively higher return loss of 20 db approximately corresponds to a VSWR of 1.2:1, which may be considered to be a good match. Depending upon the application return losses even as low as 12 dB may be considered acceptable.

The graph shown is actually the magnitude of $S_{11}$ where $S_{11}$ is expressed in magnitude phase form. The negative of this magnitude plot of $S_{11}$ in the return loss. Also indicated on the graph, are the various cellular telephone bands of operation for the multi-band antenna. Cellular frequency bands that may be transmitting and receiving on the multi-band antenna may include the amps band from 824 to 894 MHz, the AWF transmit band from 1,710 to 1,775 MHz, the AWS received band from 2,110 to 2,115 MHz and the PCS band from 1,850 to 1,990 MHz (which is disposed between the AWS TX band and the AWS RX band).

The term advanced wireless services "AWS", may include most subscriber related radio communication services such as PCS, third generation cellular services, ITU IMT-2000, Fixed Wireless Access (FWA), wireless multimedia and other technical or marketing terms.

As can be seen in the graph, the return loss or the majority of $S_{11}$ is relatively good for the bands at which the multi-band co-location insensitive multi-band antenna transmits and rescues. In the example shown, in all the bands, the return loss is typically greater than 5 db, which may be considered a good match. However, in the exemplary GPS band running from 1,565 to 1,585 MHz, which may be the band of operation of the co-located antenna, the return loss is approximately 1 db, which typically indicates good rejection of the interfering signal.

This graph may be considered to be the super position of the frequency responses of the various antenna elements previously described. For example, the amps or US cellular band antenna match $S_{11}$ response tends to be predominately created by the meander line (404 of FIG. 4). The higher frequency resonance, or good return loss extending from about 1,710 megahertz upward, tends to be created by the upper band patch (402 of FIG. 4). The upper band patch also tends to cause the sharp roll off from 1,575 megahertz to 1,710 megahertz which tends to produce good isolation between the GPS antenna and the co-location inventors multi-band antenna.

Figure 7:
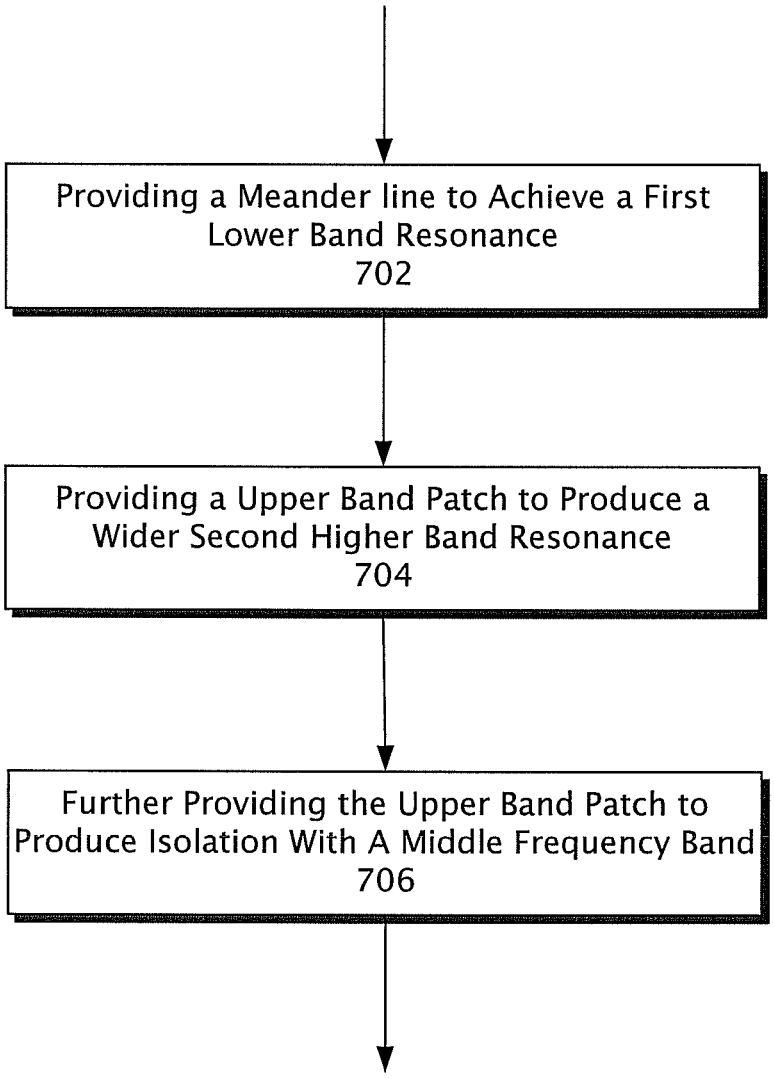
FIG. 7 is a flow diagram illustrating a method of providing a co-location insensitive multi-band antenna.

FIG. 7 is a flow diagram illustrating a method of providing a co-location insensitive multi-band antenna. First, a meander line may be provided to achieve a first lower band resonance 701. Next, an upper band patch may be provided to produce a second high band resonance 702. Next, the upper band patch may be further adjusted to produce or isolate an interfering frequency band disposed below the second resonance.

Those skilled in the art will realize that the process sequences described above may be equivalently performed in any order to achieve a desired result. Also, sub-processes may typically be omitted as desired without taking away from the overall functionality of the processes described above.

Those skilled in the art will realize, that the antenna described above may be configured in a variety of dimensions by changing the relative dielectric constant, the dielectric thickness, the metallization thickness, the metallization or metal used, and the like. Antenna dimensions may be varied in response to the changes in material parameter as is known to those skilled in the art, while maintaining the electrical characteristics of the antenna in response to changes in distributed circuit parameters. Those skilled in the art will also realize that by scaling the antenna in frequency, similar electrical performance may be achieved at differing frequencies, where circuit implementations other than distributed circuit techniques may be provided. For example, lumped circuit implementations, or a mix of distributed and lumped configurations may also be utilized. Also, various configurations for distributed implementations may be constructed by supporting the antenna on a substrate (such as a printed wiring board or a cellular telephone case), or by providing a metallization pattern thick enough, or stiff enough to support itself.

What is claimed is:

1. An antenna comprising:

a meander line for creating a first lower band frequency match; and an upper band patch coupled to the meander line at a corner of the upper band patch, for producing a second higher band match, and producing isolation from a middle frequency band, the meander line having an extending portion that extends outwardly from the corner of the upper band patch and forming a meandering path that approaches the upper band patch by meandering from an end of the extending portion back toward the upper band patch, wherein no portion of the upper band patch is located between the meandering path and the extending portion of the meander line.

2. The antenna of claim 1, in which the first lower band frequency match includes the Advanced Mobile Phone System band of frequencies, the second higher band match includes the Advanced Wireless Services band frequencies, and the middle frequency band includes the Global Positioning System band of frequencies.

3. The antenna of claim 2, in which the second higher band of frequency match includes the Personal Communications Service band of frequencies.

4. The antenna of claim 1, in which the meander line includes a straight run of transmission line cascaded with a folded run of transmission line.

5. The antenna of claim 1, in which the isolation from the middle frequency band is produced by a decrease in return loss below a highest frequency of the middle frequency band when the meander line is coupled to the upper band patch.

6. The antenna of claim 1, in which the isolation between the antenna and a co-located antenna is maximized by a roll off in a scattering parameter due to the upper band patch.

7. The antenna of claim 1, in which the antenna is a metallization pattern disposed upon a first side of a printed wiring board.

8. The antenna of claim 1, in which the antenna is a metallization pattern disposed upon a case of a radio.

9. The antenna of claim 1, in which the antenna is a metallization pattern is formed from sheet metal and self supporting.

10. A radio comprising:

a housing;

an antenna;

a middle band transceiver that is disposed in the housing and configured to transmit and receive signals over the Global Positioning System ("GPS") band through the antenna;

a co-location insensitive antenna comprising a meander line coupled to an upper band patch corner, and having an extending portion that extends outwardly from the corner of the upper band patch and forming a meandering path that approaches the upper band patch by meandering from an end of the extending portion back toward the upper band patch, wherein no portion of the upper band patch is located between the meandering path and the extending portion of the meander line, the meander line having a lower resonance and the upper band patch having an upper resonance;

a multi-band transceiver disposed in the housing and configured to transmit and receive signals through the co-location insensitive antenna, over the Advanced Mobile Phone System band of frequencies, and the frequencies of the Advanced Wireless Services band.

11. The radio of claim 10, in which the co-location insensitive antenna is disposed on the housing.

12. The radio of claim 10, in which the co-location insensitive antenna is disposed on a printed wiring board.

13. The radio of claim 10 in which the upper band patch is configured to create a shape roll off in the GPS band.

14. A method of reducing co-location interference in an antenna comprising;

providing an upper band patch to produce a high band resonance;

providing a meander line to achieve a lower band resonance, the meandering line coupled to the upper band patch at a corner of the upper band patch, and having an extending portion that extends outwardly from the corner of the upper band patch and forming a meandering path that approaches the upper band patch by meandering from an end of the extending portion back toward the upper band patch, wherein no portion of the upper band patch is located between the meandering path and the extending portion of the meander line; and further adjusting the upper band patch to produce isolation from a middle frequency band.

15. The method of reducing co-location interference in an antenna of claim 14, in which the resonances are evidenced by an increased return loss frequency response of the antenna.

16. The method of reducing co-location interference in an antenna of claim 14, in which the middle frequency band includes radio signals produced by a co-located antenna.

17. The method of reducing co-location interference in an antenna of claim 14, in which the lower band resonance and the higher band resonance are produced by cellular telephone circuitry coupled to the antenna.

* * * * *